US009080107B2

(12) United States Patent
Frączak et al.

(10) Patent No.: US 9,080,107 B2
(45) Date of Patent: Jul. 14, 2015

(54) METHOD OF PRODUCTION OF HIGH-VALUE HYDROCARBON PRODUCTS FROM WASTE PLASTICS AND APPARATUS FOR METHOD OF PRODUCTION OF HIGH-VALUE HYDROCARBON PRODUCTS FROM WASTE PLASTICS

(75) Inventors: Daria Frączak, Jaworzno (PL); Bartlomiej Samardakiewicz, Pruszków (PL)

(73) Assignee: CLARITER IP S.A., Grand-Duchëdu (LU)

( * ) Notice: Subject to any disclaimer, the term of this patent is extended or adjusted under 35 U.S.C. 154(b) by 887 days.

(21) Appl. No.: 13/322,466

(22) PCT Filed: Jul. 2, 2009

(86) PCT No.: PCT/IB2009/052883

§ 371 (c)(1),
(2), (4) Date: Feb. 20, 2012

(87) PCT Pub. No.: WO2010/136850

PCT Pub. Date: Dec. 2, 2010

(65) Prior Publication Data

US 2012/0149954 A1 Jun. 14, 2012

(30) Foreign Application Priority Data

May 25, 2009 (PL) ..... 388102

(51) Int. Cl.
*C10G 1/10* (2006.01)
*C10G 1/00* (2006.01)

(52) U.S. Cl.
CPC ..... *C10G 1/002* (2013.01); *C10G 1/10* (2013.01); *C10G 2300/1003* (2013.01); *C10G 2300/202* (2013.01); *C10G 2300/80* (2013.01)

(58) Field of Classification Search
CPC ..... C10G 1/10; C10B 31/06; C10B 19/24; C08J 11/00
USPC ..... 585/241; 201/25; 202/136, 216, 226
See application file for complete search history.

(56) References Cited

U.S. PATENT DOCUMENTS 4,747,932 A 5/1988 Miller
5,738,025 A * 4/1998 Tachibana ..... 110/346

(Continued)

FOREIGN PATENT DOCUMENTS

EP 0620264 A2 10/1994
GB 1447546 A 8/1976

(Continued)

OTHER PUBLICATIONS

International Search Report (ISR) dated Jan. 26, 2010 for International Patent Application No. PCT/IB2009/052883 published Dec. 2, 2010.

(Continued)

*Primary Examiner* — Nina Bhat
(74) *Attorney, Agent, or Firm* — Fleit Gibbons Gutman Bongini & Bianco PL; Martin Fleit; Paul D. Bianco

(57) ABSTRACT

A method and apparatus for producing high value hydrocarbon products from waste plastic is accomplished in an inert atmosphere wherein waste plastics are fed to an extruded and melted, the melted plastics is then depolymerized in a thermolysis reactor, the vapors from depolymerization are separated into hydrocarbon fractions which are then hydro refined and subjected to secondary separation and finishing operations to produce desired high value hydrocarbon products.

20 Claims, 3 Drawing Sheets

(56) References Cited

U.S. PATENT DOCUMENTS

| | | | | |
|---|---|---|---|---|
| 5,811,606 | A * | 9/1998 | Yang | 585/241 |
| 5,849,964 | A | 12/1998 | Holighaus et al. | |
| 6,143,940 | A | 11/2000 | Miller et al. | |
| 6,150,577 | A * | 11/2000 | Miller et al. | 585/241 |
| 6,190,542 | B1 | 2/2001 | Comolli et al. | |
| 6,469,203 | B1 * | 10/2002 | Weiss et al. | 560/216 |
| 6,822,126 | B2 | 11/2004 | Miller | |
| 7,714,178 | B2 | 5/2010 | Bylicki et al. | |
| 8,188,325 | B2 * | 5/2012 | DeWhitt | 585/241 |
| 8,420,875 | B1 * | 4/2013 | Mackay et al. | 585/241 |
| 8,674,154 | B2 * | 3/2014 | Podeszfa et al. | 585/241 |
| 2003/0199718 | A1 * | 10/2003 | Miller | 585/241 |
| 2006/0016724 | A1 | 1/2006 | Miller et al. | |
| 2009/0120837 | A1 | 5/2009 | Bylicki et al. | |
| 2012/0097518 | A1 * | 4/2012 | Fraczak et al. | 201/13 |

FOREIGN PATENT DOCUMENTS

| | | | |
|---|---|---|---|
| PL | 196880 | A1 | 7/2001 |
| PL | 208789 | B1 | 6/2011 |
| PL | 211493 | B1 | 5/2012 |
| PL | 212463 | B1 | 10/2012 |
| WO | 2004037906 | A1 | 5/2004 |
| WO | 2007047063 | A2 | 4/2007 |

OTHER PUBLICATIONS

International Preliminary Report on Patentability dated Nov. 29, 2011 for International Patent Application No. PCT/IB2009/052883 published Dec. 2, 2010.

* cited by examiner

METHOD OF PRODUCTION OF HIGH-VALUE HYDROCARBON PRODUCTS FROM WASTE PLASTICS AND APPARATUS FOR METHOD OF PRODUCTION OF HIGH-VALUE HYDROCARBON PRODUCTS FROM WASTE PLASTICS

FIELD OF THE INVENTION

The object of the invention is a method of production high-value hydrocarbon products from waste plastics and an apparatus for method of production high-value hydrocarbon products from waste plastics.

BACKGROUND OF THE INVENTION

From patent PL 196880 it is known method for getting hydrocarbon oils consisted on putting into intake hopper of extruder or other feeding device the milled plastic with cracking catalyst which are transported to bottom part of reactor in which in temperature of 380-500° C. polymeric chains' cracking and producing light hydrocarbons takes place. Those light hydrocarbons are passing to air cooler from which vapor-liquid mixture is transported to separator from which the liquid phase is returned into cracking reactor and gaseous phase is conducted to water-cooled condenser followed by cracking gas tank. The liquid phase is separated on gasoline fraction conducted into tank and diesel oil conducted into tank in distillation column. Direction of conducting of cracked plastic and heating fumes is countercurrent. Waste plastic cracking reactor is characterized in that in top of reactor is tube heat exchanger connected with gas or fuel oil burners and liquid plastic level measuring device is installed over heat exchanger. In the bottom of reactor under heat exchanger wall the revision hutch is situated.

From patent application description No P-381389 it is known device for transforming thermoplastic plastic wastes especially into liquid fuel and method of transforming thermoplastic plastic wastes. The device for transforming thermoplastic wastes consists of reactor unit connected with rectification column through hydrotreating reactor and steam reforming column and reactor is divided on modules and is built of depolymerization chamber, condensation chamber and cooler situated one over one. Method of transforming waste thermoplastic plastics is based on milling, washing, concentrating and heating of wastes and after feeding mixture into reactor depolymerization process is carried out. Gaseous phase and condensate are separated and condensed phase after removing gaseous phase is hydrotreated. Plastic wastes are heated up to 300-650° C., favorably 450° C., getting liquid phase which is fed to reactor in form of nebulized fog.

From patent application No P-381533 , applied for protection on 15 Jan. 2007, involving method of separation polyolefinic waste plastics destructive treatment products there is known two-step vapor condensation. In the first step of separation product vapors are partly condensed in the column using cooled fraction, favorably medium fraction, fed in such a portion that vapor temperature after first step of condensation is about 250-300° C. and at the same time condensed heavy fraction is collected. In the second step of condensation product vapors are cooled in cooler to 110-130° C. and cooled mixture is rectified in the column and vapors from top of the column are condensed in cooler and separated on gaseous phase, water phase and liquid hydrocarbon phase in separator. That liquid hydrocarbon phase is partly returned to the column as a reflux and partly collected as a light fraction. Steam is injected to the rectification column in amount 10% in proportion to amount of processed destruction products. Residue is received from the bottom of column and is partly returned to the column as a reflux and partly collected as a medium phase after cooling.

From invention application description No P-382405 it is known method of processing polyolefin waste plastics for getting mixture of liquid hydrocarbons which can be components or getting solvent for asphalted hydroisolation mass and sulphur-less ecological fuel oil after distillation. Solution is characterized in that the process is carried out in two steps and feedstock after segregation and comminuting is melted in two-section melter and then melted feedstock is collected in heated melted plastic buffering tank and maintained in 250° C. where preliminary sedimentation of solid impurities which are removed by screw and melted plastic after mixing with powder catalyst is fed into first step of depolymerization reactors. After depolymerization in 300-400° C. vapors are conducted into second step degradation reactor where further hydrocarbon cracking and reforming processes are carried out on solid catalyst in temperature of 260-300° C. Obtained vapors come through dual-stage condensation system and are condensed in tanks and in liquid form are conducted to final product tank.

From patent description U.S. Pat. No. 5,849,964 it is known method of getting chemical row materials and fuels from waste plastics by depolymerization of wastes which are transformed into a pumpable and into volatile phase. The volatile phase is separated into a gaseous phase and condensate or condensable depolymerization product which are refined by standard usual procedures. the pumpable phase remaining one the volatile phase is separated is subjected to liquid phase hydrogenation, gasification, low temperature carbonization or to a combination of said processes.

From patent description U.S. Pat. No. 6,150,577 it is known a method for transforming waste plastics into lubricating oils. The process includes pyrolysis of mainly waste polyethylene in a pyrolysis zone at pyrolysis conditions, whereby at least a portion of the plastics is cracked into 1-olefins and n-paraffins including separation of heavy fraction and middle fraction.

From patent description U.S. Pat. No. 6,822,126 it is known a continuous process for converting waste plastics into lube oils. The plastic feed is maintained in a heater at preferred temperatures of 150-350° C. The feed is continuously passed to a pyrolysis reactor preferably maintained at a temperature of 450-700° C. and at atmospheric pressure. Relatively short residence times are employed. The reactor effluent is processed in a hydrotreating unit and an isomerization dewaxing. Preferably, the feed to the pyrolysis reactor can be a blend of waste plastic and waxy Fischer-Tropsch fractions.

Principal aim of the invention is method of thermolysis of waste plastics and adequate for this method apparatus for obtaining high-value different products in the same hydrorefining system.

SUMMARY OF THE INVENTION

Method of obtaining high-value hydrocarbon products from waste plastics in inert gas atmosphere in which wastes are continuously fed into extruder and melted then depolymerized in thermolysis reactor and depolymerization product vapors are conducted into preliminary separation unit in which introductory separation of those takes place; according to the invention is characterized in that obtained fractions are hydrorefined and then conducted to secondary separation unit and additional finishing operations unit.

Favorably all product fractions obtained in preliminary separation unit are hydrorefined one by one in charges in the same system.

Favorably product fractions are catalytically hydrogenated and then catalytically hydrodesulphurized and then secondly separated.

Favorably hydrogenated and desulphurized products fractions are catalytically dewaxed and then conducted to secondary separation unit.

Favorably in preliminary separation unit depolymerization products vapors are separated in two steps.

Favorably in feedstock feeding unit plastics are melted and mixed with powder additives.

Favorably powder additives are carbonates, bicarbonates, aluminosilicates or oxides of iron, aluminum, zinc, magnesium, calcium or sodium.

Favorably in first step of preliminary separation unit a vapors separation into two fractions: light which is consisted of hydrocarbon with up to 15 carbon atoms in chain and heavy which is consisted of hydrocarbon with more than 15 carbon atoms in chain in condenser is obtained.

Favorably heavy fraction from first step of preliminary separation unit is separated in second step of separation using vacuum evaporator into heavy oil fraction consisting of hydrocarbons with up to 24 carbon atoms in chain and waxy fraction consisting of hydrocarbons with more than 24 carbon atoms in chain.

Favorably light oils and heavy oils are decolorized in adsorber using bleaching clay.

Favorably waxes are blended with heavy oils.

Apparatus for continuous obtaining high-value hydrocarbon products from waste plastics consisted of feedstock feeding unit, depolymerization reactor and preliminary separation of products unit according to the invention is characterized in that after preliminary separation unit hydrotrefining system and then secondary separation unit and finishing operations unit are situated.

Favorably hydrorefining system consists of catalytic hydrogenation reactor and catalytic hydrodesulphurization reactor.

Favorably hydrorefining system consists of catalytic hydrogenation reactor, catalytic hydrodesulphurization reactor and catalytic dewaxing reactor.

Favorably after preliminary separation unit the catalytic hydrogenation reactor is situated and after that the catalytic hydrodesulphurization reactor is situated.

Favorably system contains the catalytic dewaxing reactor.

Favorably catalytic hydrogenation reactor and catalytic hydrodesulphurization reactor consist of two connected in series elementary flow tubular reactors.

Favorably catalytic hydrogenation reactors and catalytic hydrodesulphurization reactors diameter and length ratio equals at least 1:30.

Favorably catalytic dewaxing reactors diameter and length ratio equals at least 1:30.

Favorably secondary separation unit is connected with hydrodesulphurization reactor and dewaxing reactor.

Favorably secondary separation unit includes distillation column.

Favorably finishing operations unit includes at least one adsorber.

Main advantage of the invention is designing complex system for full continuous converting of waste plastics especially polyolefins into high-value products with very high purity grade which can be used in chemical, cosmetic or pharmaceutical industry.

Unexpectedly it was turned out that using two processes of separation of the product into fractions—firstly before hydrorefining and secondly after hydrorefining—ensures precise separation of fractions and enables avoiding secondary degradation reactions of temperature-sensitive products proceeding. It ensures high purity grade of products and also great flexibility of all process and opportunity of getting wide range of different products depending on market requirements.

Important novelty of the invention is sequence of hydrorafination processes carrying out. Hydrogenation is the first process and hydrodesulphurization is next. Such a processes order ensures removing sulphur, nitrogen and oxide compounds and aromatic compounds impurities up to level of few or several ppm and also reduction energy costs for heating feedstock stream because of secondary heating in hydrogenation reactor caused exothermal character of this reaction. Additionally using catalytic dewaxing process of oil fractions improves their properties as a commercial products by reducing pour point of obtained oils and applications broadening as a result.

Moreover, using two elementary tubular reactors connected in series as a hydrogenation reactor and as a hydrodesulphurization reactor allows recurring change of only drained part of catalyst, without admitting to contact residual part of catalyst in second elementary reactor with oxygen containing atmosphere which causes catalyst deactivation. As a result a lower consumption of catalyst is gained and that brings about rise of process cost-effectiveness. That enables using independently one catalyst bed with less active and cheaper catalyst as a introductory hydrogenation/hydrodesulphurization catalyst and second catalyst bed with more active and more expensive catalyst and that also reduces costs of production.

In case of using absorbers with bleaching clay as a reactor for finishing operations reproducibility of obtained oils properties such as color or transparency are guaranteed because of removing residual impurities generated during distillation. Thanks to blending of high-value waxes with oils the cosmetic petroleum jelly being up to quality standard is obtained.

BRIEF DESCRIPTION OF THE DRAWING

The object of the invention is reconstructed in example on the fig on which

DETAILED DESCRIPTION OF THE INVENTION

Figure 1:
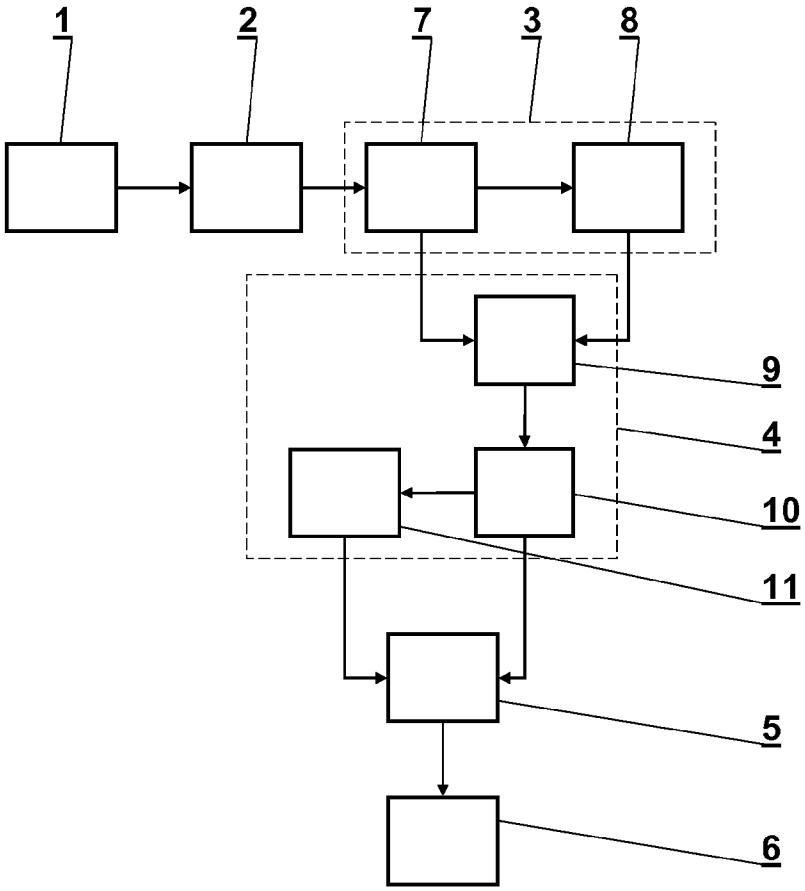
FIG. 1—scheme of the whole system for thermolysis process
Figure 2:
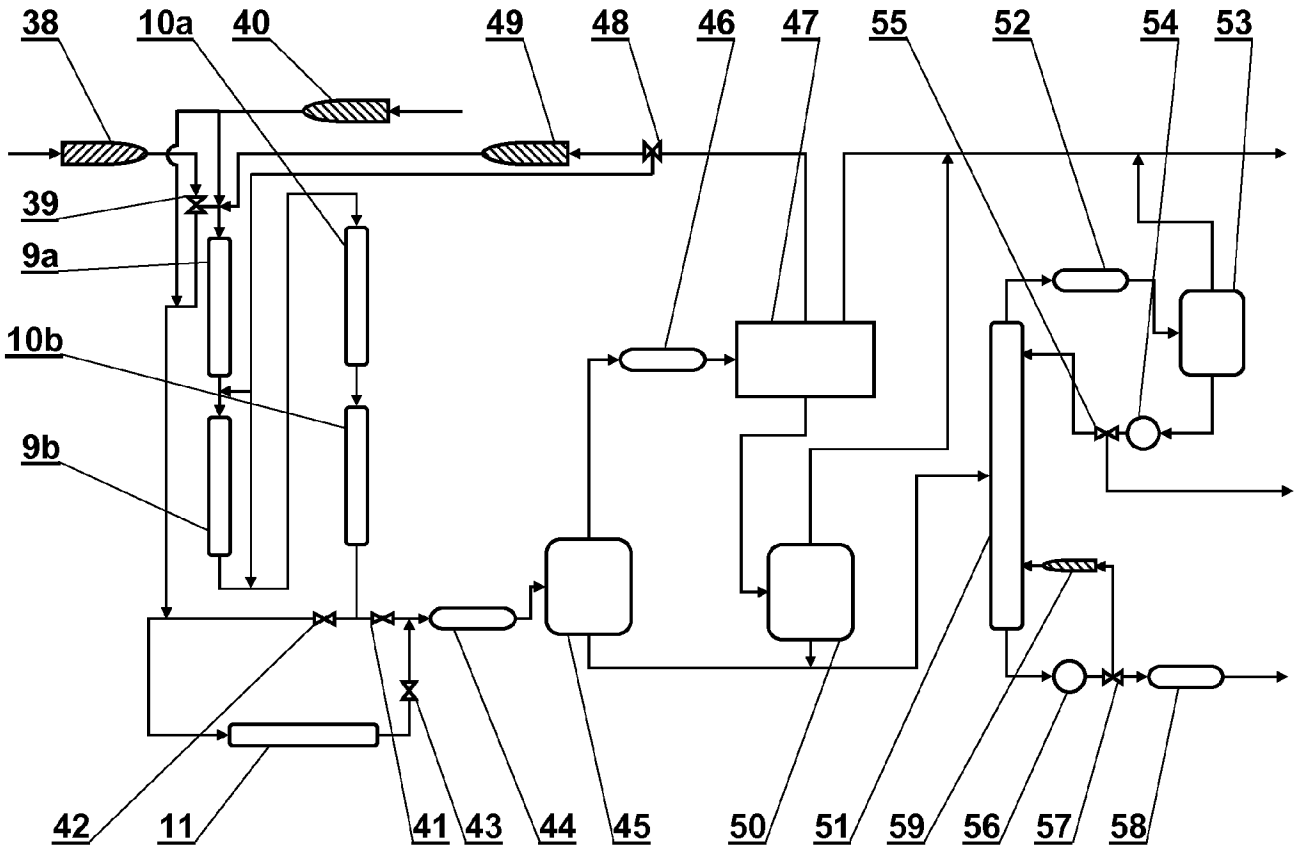
FIG. 2—scheme of the hydrorefining system
Figure 3:
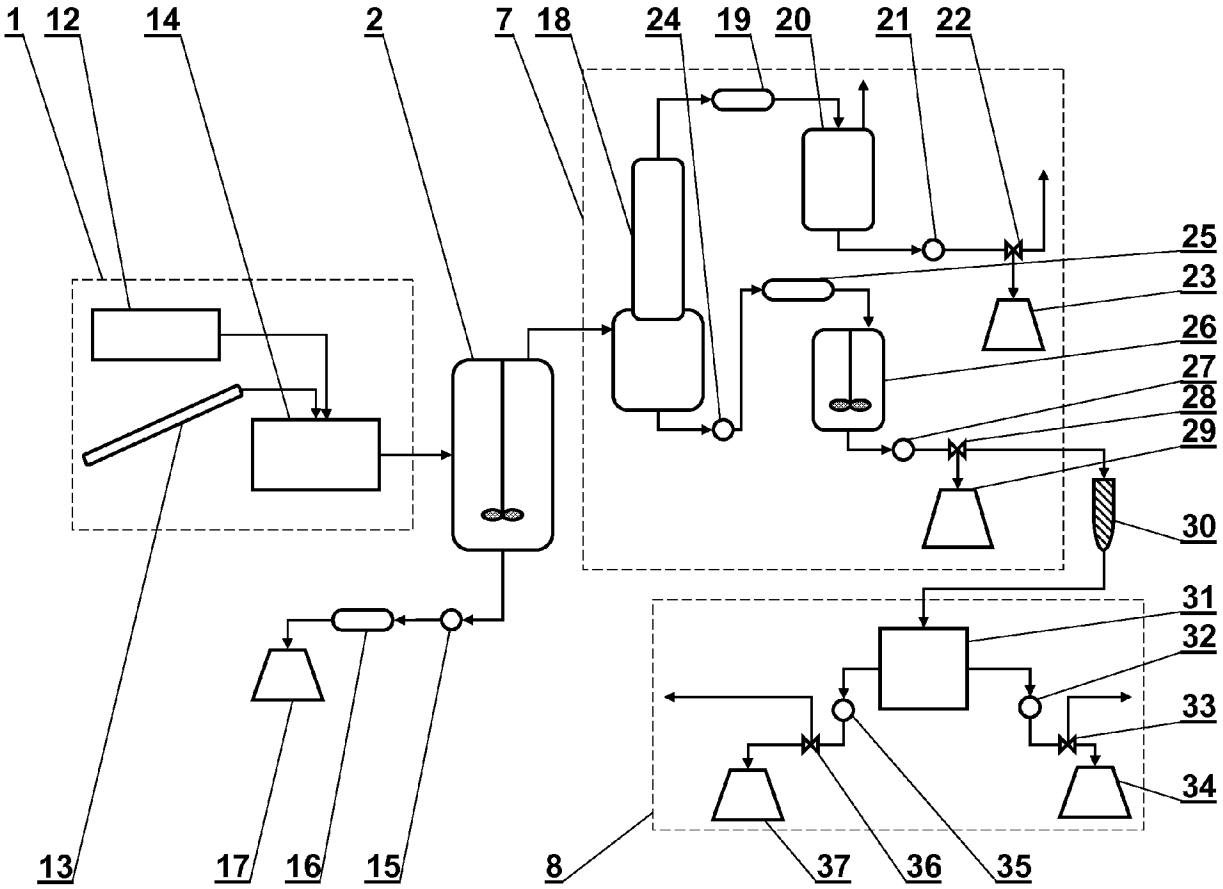
FIG. 3—scheme of thermolysis unit without hydrorefining

Example of implementation caused below do not limit possibilities of use of the invention.

Example of Implementation

System for continuous obtaining of high-value hydrocarbon products from waste plastics according to invention consists of feedstock feeding unit 1 including belt granulate or leaf-shaped plastic feeder 13 and powder additives screw feeder 12 and extruder where plastic melting and mixing with powder additives takes place. Those powder additives can be different aluminosilicates, calcium, magnesium carbonates, alumina oxides, ferrous oxides or different mixtures of these. Such obtained mass after heating up to temperature of 300-330° C. is fed to depolymerization reactor 2, with propeller and residue removing system consisting seriatim of high temperature working pump 15, oil cooled heat exchanger 16 in which residua is cooled and residua tank 17. Depolymerization process is carried out in reactor 2 in temperature from 390° C. up to 430° C. and obtained mixture of products vapors is conducted to first step of preliminary separation unit 7 consisting direct contact condenser 18, light fraction receiver 20 and heavy fraction receiver 26. Light fraction consisting hydrocarbons with up to 15 carbon atoms in chain is received from condenser in form of vapors and then condensed in heat exchanger 19 consisted of two heat exchangers connected in series, cooled seriatim by oil and by water. Mixture of condensed light fraction and residual products in gaseous form are conducted to receiver 20 from which gases are passed into further part of system as a fuel gas and liquid is pumped by pump 21 to three-way valve 22 and is further conducted to tank 23 or to hydrorefining system 4. Raw heavy fraction consisted of hydrocarbons with more than 15 carbon atoms in chain from condenser is pumped by pump 24 to oil cooled heat exchanger 25 and then to raw heavy fraction receiver 26. Receiver 26 has propeller and is externally heated electrically. Raw heavy fraction is pumped from receiver 26 by pump 27 to three-way valve 28 from which is conducted either to tank 29 or through diaphragm oil heater 30 to second step of preliminary separation unit 8. Second step of preliminary separation unit 8 includes a wiped film evaporator 31 in which fraction separation into two heavy oil and wax takes place. Heavy oil is pumped by pump 32 into three-way valve 33 dividing stream of heavy oil into stream conducted to tank 34 and stream conducted to hydrorefining system 4. The wax is pumped by pump 35 to three-way valve 36 dividing stream of wax into stream conducted to tank 37 or stream conducted to hydrorefining system 4. Heavy oil includes hydrocarbons with up to 24 carbon atoms in chain and wax includes hydrocarbons with more than 24 carbon atoms in chain. Each of fractions—light oil, heavy oil and wax—is hydrotrefined in the same system one by one in charges depending on market requirements. Products from preliminary separation unit are heated in electrical heater 38 up to temperature of 200 to 330° C. and by three-way valve 39 divided on two streams—one conducted to hydrogenation reactor 9 and second conducted to dewaxing reactor 11. Fresh hydrogen heated in electrical heater 40 up to temperature of 210 to 350° C. is conducted independently to hydrogenation reactor 9 and dewaxing reactor 11. Hydrogenation reactor 9 includes two elementary tubular reactors 9*a* and 9*b* connected in series which have diameter 40 times shorter than length. What is more unreacted, returned from further part of system hydrogen is conducted to second elementary reactor 9*b* without heating and part of this hydrogen heated in electrical heater 49 is conducted to first elementary hydrogenation reactor 9*a*. Mixture of hydrogenated fraction and unreacted hydrogen supplemented by fresh hydrogen is conducted to hydrodesulphurization reactor 10. Reactor 10 consists of two elementary tubular reactor 10*a* and 10*b* connected in series having diameter 40 times shorter than length. Desulphured fraction is conducted by valves 41 and 42 to heat exchanger 44 in which fraction is cooled or to catalytic dewaxing reactor 11. Dewaxing reactor 11 is a tubular reactor with 40 times shorter diameter than length. Dewaxed fraction from dewaxing reactor 11 is conducted through valve 43 to oil cooled heat exchanger 44. Cooled product passes then to high pressure separator 45 from which vapors are conducted through high pressure heat exchanger 46 high pressure gas-liquid separator fed by water and liquid is conducted to stripping column 51. Hydrogen from high pressure receiver 47 is conducted to three-way valve 48 and returned to hydrogenation reactor 9 and hydrodesulphurization reactor 10. Obtained gaseous products are conducted to further part of system as a fuel gas and liquid separated from water in high pressure separator receiver 47 is conducted to low-pressure flash tank 50 and to stripping column 51 after gases conducted as a fuel gas to further part of system removing. In stripping column 51 next gases separation takes place. Gases are conducted through water cooled heat exchanger 52 to overhead receiver 53 from which gases are conducted to further part of system as a fuel gas and part of liquid is pumped by pump 54 through three-way valve 55 for next processing and part of this liquid is returned to the column to liquid products pumped by pump 56 to three-way valve 57 dividing these on stream heated in electrical heater 59 and returned to the column 51 and stream conducted through heat exchanger 58 for further processing. Heat exchanger 58 consists of two heat exchangers connected in series. First exchanger is cooled by oil and second is cooled by water. Hydrorefined fractions are conducted to distillation column in which separation into target products from solvents group, light oils group, heavy oils group and waxes takes place—depending on distilled inlet fraction and outlet received products. Light and heavy oils are conducted to the two adsorbers with bleaching clay as a adsorber and after passing the filters with porosity of 10 to 30 microns are conducted to clay treated oil tank from which are conducted through next two filters with porosity of 0,5 to 2 microns for packing. Gases obtained in all process are burnt as a fuel gas in heater of oil used in different steps of process.

The invention claimed is:

1. A method of obtaining high-value hydrocarbon products from plastic waste in an inert gas atmosphere comprising:

continuously feeding plastic waste into an extruder;

melting the plastic waste in the extruder to obtain a melt;

depolymerizing the melt in a thermolysis reactor;

conducting depolymerization product vapors into a preliminary separation unit;

separating the vapors into fractions in the preliminary separation unit by an introductory separation;

hydrorefining the obtained fractions; and conducting the hydrorefined fractions to a secondary separation unit and to a finishing operations unit.

2. The method according to claim 1, wherein all product fractions obtained in the preliminary separation unit are hydrorefined one by one in charges in the same system.

3. The method according to claim 1, wherein product fractions are catalytically hydrogenated then catalytically hydrodesulphurized and then secondly separated.

4. The method according to claim 3, wherein the hydrogenated and desulphurized product fractions are catalytically dewaxed and then conducted to the secondary separation unit.

5. The method according to claim 1, wherein depolymerization product vapors are separated in the preliminary separation unit in two steps.

6. The method according to claim 1, wherein the plastic waste is melted and mixed with powder additives in a feedstock feeding unit.

7. The method according to claim 6, wherein the powder additives are selected from the group consisiting of carbonates, bicarbonates, aluminosilicates, oxides of iron, aluminum, zinc, magnesium, calcium, and sodium.

8. The method according to claim 1, wherein the separating in the preliminary separation unit results in condensed vapors, which are separated into a light fraction and a heavy fraction, wherein the light fraction consists of hydrocarbons of up to 15 carbon atoms in chain and the heavy fraction consists of hydrocarbons with more than 15 carbon atoms in chain.

9. The method according to claim 8, further comprising separating the heavy fraction, using a vacuum evaporator, into a heavy oil fraction consisting of hydrocarbons with up to 24 carbon atoms in chain and a waxy fraction consisting of hydrocarbons with more than 24 carbon atoms in chain.

10. The method according to claim 8, wherein the light fraction and the heavy fraction are decolorized in an adsorber using bleaching clay.

11. The method according to claim 8, wherein waxes are blended with the heavy fraction.

12. An apparatus for continuously obtaining high-value hydrocarbon products from plastic waste, the apparatus comprising a feedstock feeding unit, a depolymerization reactor, a preliminary separation unit, a hydrorefining system, a secondary separation unit, and a finishing operations unit, wherein the hydrorefining system is situated after the preliminary separation unit, the secondary separation unit is situated after the hydrorefining system, and the finishing operations unit is situated after the secondary separation unit.

13. The apparatus according to claim 12, wherein the hydrorefining system consists of a catalytic hydrogenation reactor and a catalytic hydrodesulphurization reactor.

14. The apparatus according to claim 12, wherein the hydrorefining system consists of a catalytic hydrogenation reactor, a catalytic hydrodesulphurization reactor, and a catalytic dewaxing reactor.

15. The apparatus according to claim 13, wherein the catalytic hydrogenation reactor is situated after the preliminary separation unit and the catalytic hydrodesulphurization reactor is situated after the catalytic hydrogenation reactor.

16. The apparatus according to claim 13, wherein the catalytic hydrogenation reactor and the catalytic hydrodesulphurization reactor each consist of two elementary flow tubular reactors connected in series.

17. The apparatus according to claim 16, wherein the catalytic hydrogenation reactors and the catalytic hydrodesulphurization reactors diameter to length ratio is at least 1:30.

18. The apparatus according to claim 14, wherein the catalytic dewaxing reactors diameter to length ratio is at least 1:30.

19. The apparatus according to claim 14, wherein the secondary separation unit is connected to the hydrodesulphurization reactor and the catalytic dewaxing reactor.

20. The apparatus according to claim 12, wherein the finishing operations unit comprises at least one adsorber.

* * * * *